US007011373B1

(12) United States Patent
Hsieh

(10) Patent No.: US 7,011,373 B1
(45) Date of Patent: Mar. 14, 2006

(54) FURNITURE ASSEMBLY

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 0 days.

(21) Appl. No.: 10/993,682

(22) Filed: Nov. 19, 2004

(51) Int. Cl.
*A47C 7/02* (2006.01)

(52) U.S. Cl. ..... 297/452.41; 297/452.2; 297/452.17

(58) Field of Classification Search ..... 297/452.41, 297/452.17, 452.18, 452.2, 448.1, 440.24, 297/229
See application file for complete search history.

(56) References Cited

U.S. PATENT DOCUMENTS 3,220,769 A * 11/1965 Regan ..... 297/250.1
3,420,574 A * 1/1969 Smith ..... 297/452.41
3,499,682 A * 3/1970 Orenstein ..... 297/452.41
3,635,528 A * 1/1972 Strom ..... 297/452.41
3,680,918 A * 8/1972 Briggs ..... 297/452.41
4,789,202 A * 12/1988 Alter ..... 297/284.6
5,487,197 A * 1/1996 Iskra et al. ..... 5/654
5,560,056 A * 10/1996 Tai ..... 5/120
5,599,068 A * 2/1997 Kelly et al. ..... 297/448.1
5,947,563 A * 9/1999 Klimenko ..... 297/452.41

* cited by examiner

*Primary Examiner*—Milton Nelson, Jr.
(74) *Attorney, Agent, or Firm*—Abelman, Frayne & Schwab

(57) ABSTRACT

A furniture assembly includes a flexible outer envelope, an inner envelope, and a rigid inner frame. The outer envelope includes an upper receiving chamber, an upper access opening in communication with the upper receiving chamber, a lower receiving chamber, and a lower access opening in communication with the lower receiving chamber. The inner envelope is disposed in the upper receiving chamber, and is filled with a cushioning material. The rigid inner frame is disposed in the lower receiving chamber.

12 Claims, 7 Drawing Sheets

FURNITURE ASSEMBLY

BACKGROUND OF THE INVENTION

1. Field of the Invention

The invention relates to a furniture assembly, more particularly to a furniture assembly, such as a chair, that is easy to assemble and that provides good support.

2. Description of the Related Art

Generally, a conventional inflatable mattress or sofa bed relies only on air introduced into an inner portion thereof to maintain its shape and to support the weight of a user. When the air introduced into the conventional inflatable mattress or sofa bed is insufficient, the conventional inflatable mattress or sofa bed is uncomfortable and unsafe to use.

SUMMARY OF THE INVENTION

Therefore, the object of the present invention is to provide a furniture assembly that can be easily manufactured, transported, assembled, and stored, that stably maintains its shape, and that provides good support.

According to this invention, a furniture assembly comprises a flexible outer envelope, an inner envelope, and a rigid inner frame. The outer envelope includes an upper receiving chamber, an upper access opening in communication with the upper receiving chamber, a lower receiving chamber, and a lower access opening in communication with the lower receiving chamber. The inner envelope is disposed in the upper receiving chamber, and is filled with a cushioning material. The rigid inner frame is disposed in the lower receiving chamber.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
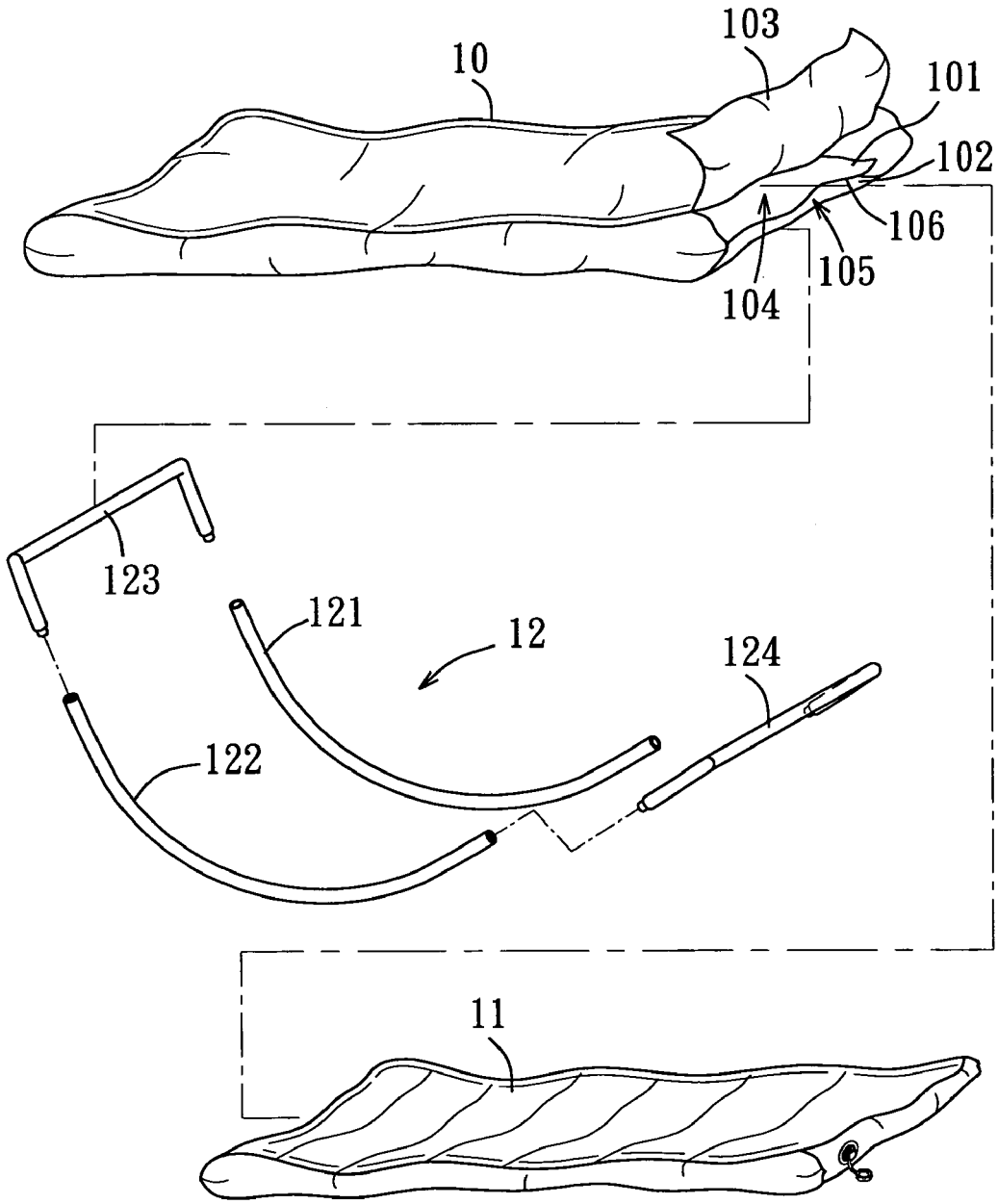
FIG. 1 is an exploded perspective view of a combined seat and backrest unit of the first preferred embodiment of a furniture assembly according to the present invention.
Figure 2:
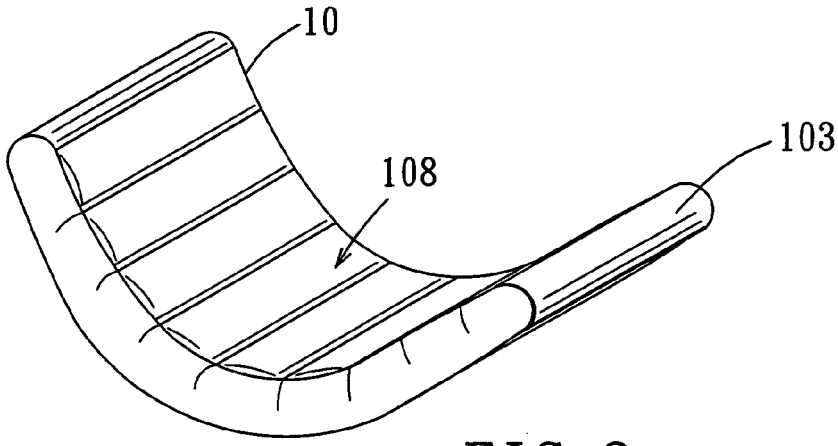
FIG. 2 is a perspective view of the combined seat and backrest unit of FIG. 1 in an assembled state.

Referring to FIGS. 1 and 2, a combined seat and backrest unit 108 of the first preferred embodiment of a furniture assembly 1 (see FIG. 5) according to the present invention is shown to comprise a flexible outer envelope 10, an inner envelope 11, and a rigid inner frame 12.

The flexible outer envelope 10 is substantially rectangular when laid flat on the ground, and includes an upper receiving chamber 104, an upper access opening 101 in communication with the upper receiving chamber 104, a lower receiving chamber 105 that is smaller than the upper receiving chamber 104, and a lower access opening 102 in communication with the lower receiving chamber 105. The outer envelope 10 further includes a partition sheet 106 for separating the upper and lower receiving chambers 104, 105, and a closure member, in the form of a flap 103, to close the upper and lower access openings 101, 102.

The inner envelope 11 is disposed in the upper receiving chamber 104, and is filled with a cushioning material, such as air, water, or a foam material. In actual use, the inner envelope 11 is first inserted into the upper receiving chamber 104 through the upper access opening 101, after which the cushioning material is introduced into the inner envelope 11 so as to fill up the upper receiving chamber 104 with the cushioning material. It is to be noted that the inner envelope 11 is not limited to the disclosed embodiment, and, depending on the manufacturing and use requirements, may be formed including two, three or more filling sections arranged alongside one another.

The rigid inner frame 12 is disposed in the lower receiving chamber 105 through the lower access opening 102. In this embodiment, the inner frame 12 includes left and right support rods 122, 121, each of which has front and rear ends, a front U-shaped bent rod 124 extending across and connected to the front ends of the left and right support rods 122, 121, and a rear U-shaped bent rod 123 extending across and connected to the rear ends of the left and right support rods 122, 121.

The outer envelope 10, the inner envelope 11, and the inner frame 12 cooperatively form the combined seat and backrest unit 108 after the inner envelope 11 and the inner frame 12 are inserted respectively into the upper and lower receiving chambers 104, 105 of the outer envelope 10. The inner frame 12 is formed as a combined seat and backrest frame. The inner envelope 11 is shaped to match with the inner frame 12.

The flap 103 may be provided with a fastening unit (not shown), such as a zipper or male and female fasteners, to close the upper and lower access openings 101, 102.

When the combined seat and backrest unit 108 is placed on the ground for use, because of the rigid and curve configuration of the inner frame 12, the combined seat and backrest unit 108 can undergo back and forth movement like a rocking chair.

Figure 3:
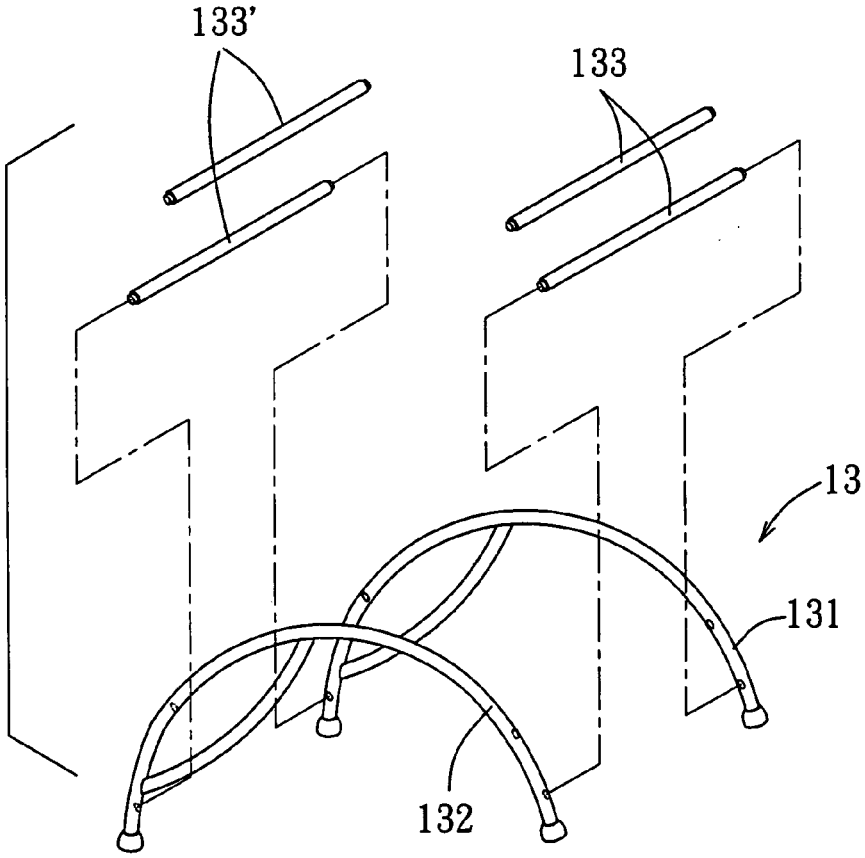
FIG. 3 is an exploded perspective view of a leg frame of the first preferred embodiment.
Figure 4:
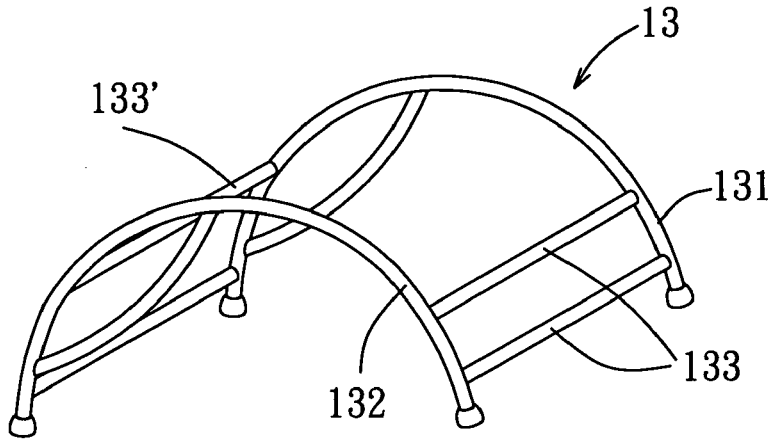
FIG. 4 is a perspective view of the leg frame of FIG. 3 in an assembled state.
Figure 5:
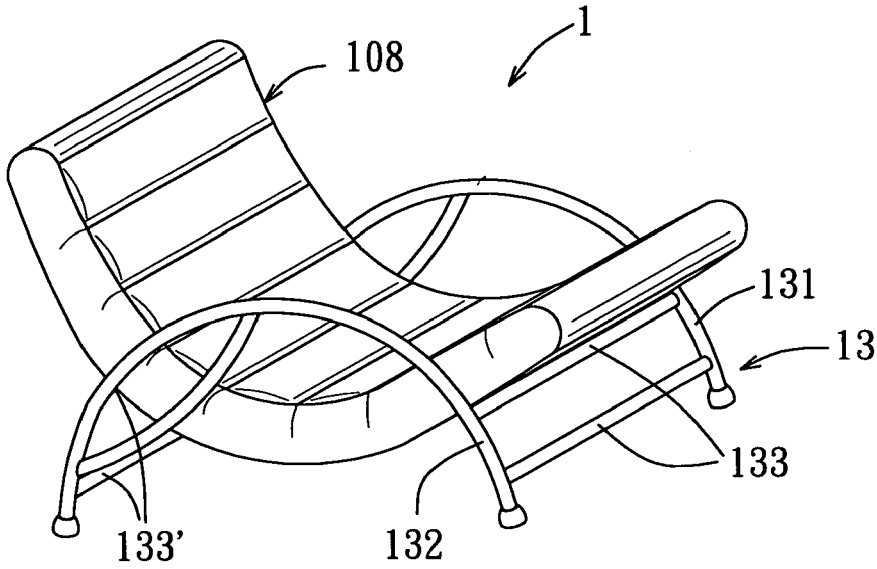
FIG. 5 is a perspective view of the first preferred embodiment of the furniture assembly of the present invention.
Figure 6:
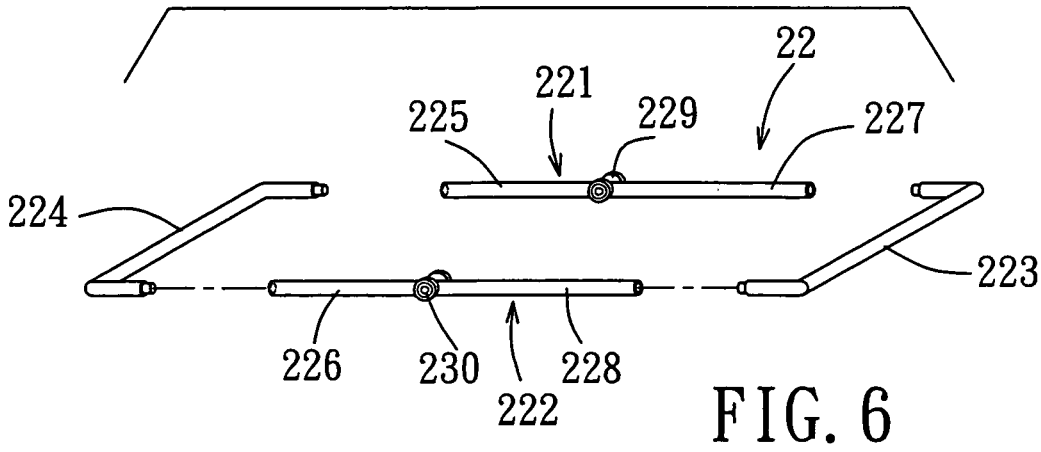
FIG. 6 is an exploded perspective view of an inner frame of the second preferred embodiment of a furniture assembly according to the present invention.
Figure 7:
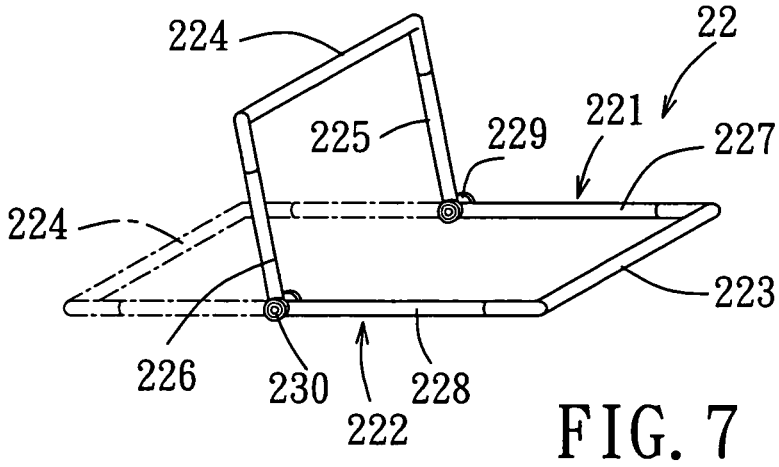
FIG. 7 is a perspective view of the inner frame of FIG. 6 in an assembled state.

Referring to FIGS. 3 to 5, the furniture assembly 1 further comprises a leg frame 13 for supporting the combined seat and backrest unit 108 on the ground. In this embodiment, the leg frame 13 includes two substantially inverted-C shaped legs 131, 132, each of which has front and rear ends, a pair of front cross bars 133 interconnecting the front ends of the inverted-C shaped legs 131, 132, and a pair of rear cross bars 133' interconnecting the rear ends of the inverted-C shaped legs 131, 132. The length of each cross bar 133, 133' is similar to the width of the combined seat and backrest unit 108.

Referring to FIGS. 6 to 10, the second preferred embodiment of a furniture assembly 2 according to the present invention is shown to be similar to the first preferred embodiment. Particularly, the combined seat and backrest unit 208 of the furniture assembly 2 comprises an outer envelope 20, an inner envelope (not shown) disposed within the outer envelope 20, and an inner frame 22. In this embodiment, the length of the outer envelope 20 is shorter than that of the outer envelope 10 in the first preferred embodiment. The inner frame 22 includes left and right support rods 222, 221, each of which has a front rod section 228, 227, a rear rod section 226, 225, and an angle adjusting and limiting unit 230, 229 interconnecting the front and rear rod sections 228, 227, 226, 225. A front U-shaped bent rod 223 extends across and is connected to the front rod sections 228, 227 of the left and right support rods 222, 221; A rear U-shaped bent rod 224 extends across and is connected to the rear rod sections 226, 225 of the left and right support rods 222, 221.

Each angle adjusting and limiting unit 229, 230 in this embodiment includes a conventional ratchet mechanism, and permits the rear rod section 226, 225 of the left or right support rod 222, 221 to pivot relative to the front rod section 228, 227 of the left or right support rod 222, 221 and to be positioned at a selected angle with respect to the corresponding front rod section 228 or 227.

Figure 8:
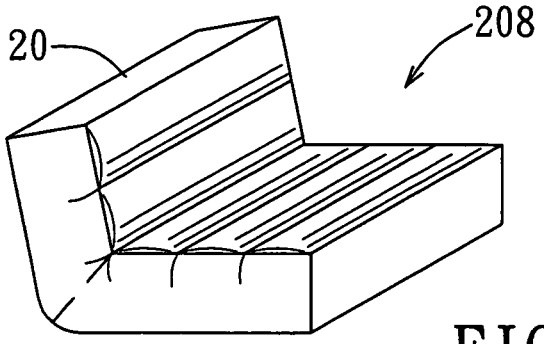
FIG. 8 is a perspective view of a combined seat and backrest unit of the second preferred embodiment.

When the combined seat and backrest unit 208 is placed on the ground for use, the rear rod sections 226, 225 of the left and right support rods 222, 221 are pivoted relative to the front rod sections 228, 227 so that the combined seat and backrest unit 208 is moved from a flat state to a folded state shown in FIG. 8. When the rear rod sections 226, 225 are pivoted back to the flat state, the combined seat and backrest unit 208 becomes a sofa bed.

Figure 9:
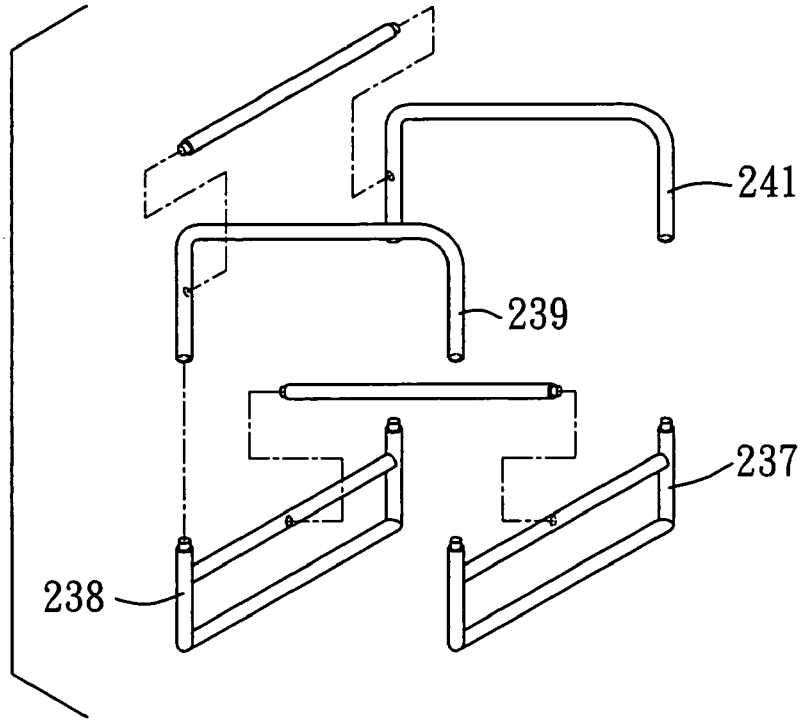
FIG. 9 is an exploded perspective view of a leg frame of the second preferred embodiment.
Figure 10:
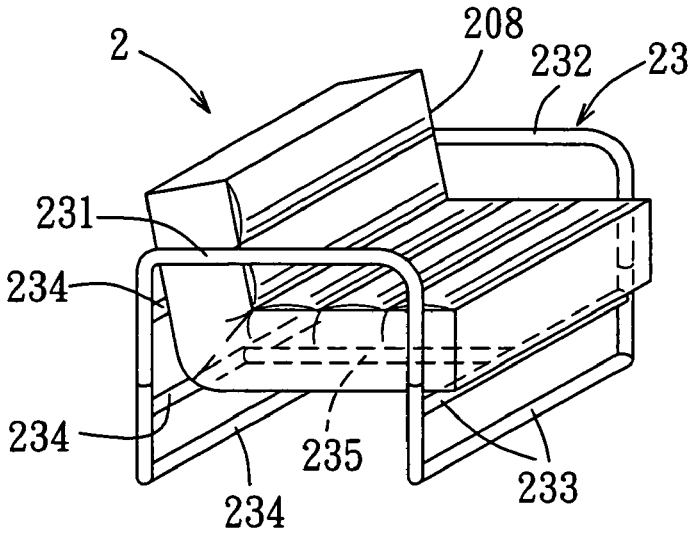
FIG. 10 is a perspective view of the second preferred embodiment of the furniture assembly of the present invention.
Figure 11:
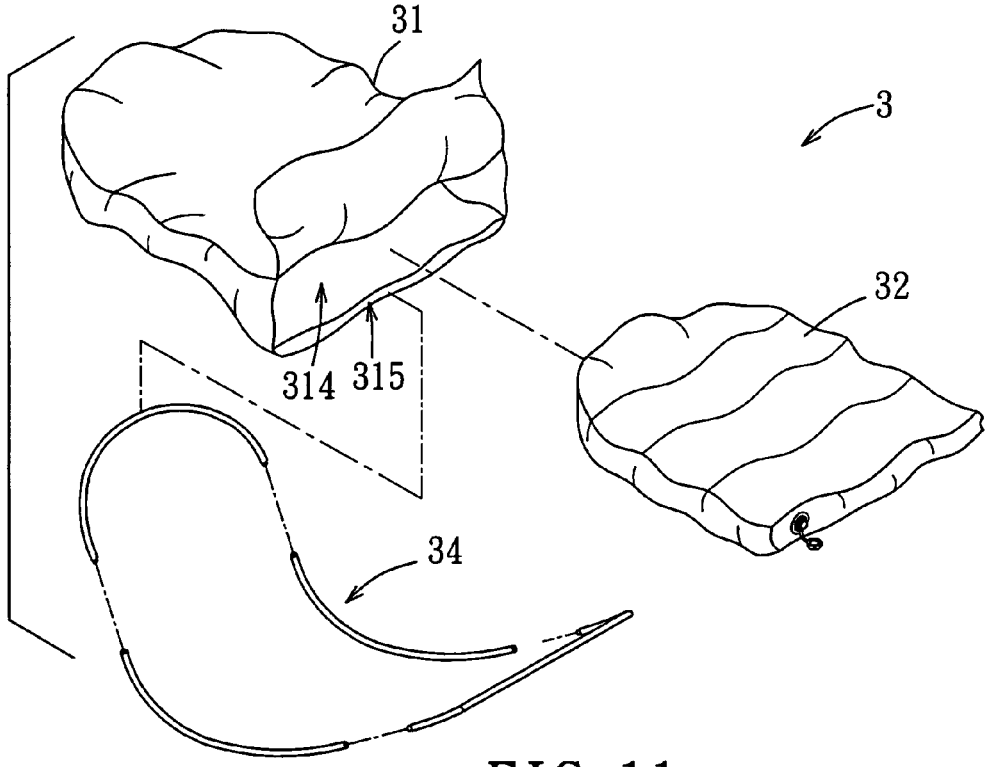
FIG. 11 is an exploded perspective view of a combined seat and backrest unit of the third preferred embodiment of a furniture assembly according to the present invention.

The furniture assembly 2 further comprises a leg frame 23 for supporting the combined seat and backrest unit 208 on the ground. As shown in FIG. 10, the leg frame 23 includes two substantially inverted-U shaped legs 231, 232, each of which has front and rear ends, a pair of front cross bars 233 interconnecting the front ends of the inverted-U shaped legs 231, 232, three rear cross bars 234 interconnecting the rear ends of the inverted-U shaped legs 231, 232, and an intermediate cross bar 235 interconnecting one of each of the front and rear cross bars 233, 234. The inverted-U shaped legs 231, 232 are constructed from a pair of substantially inverted-U shaped first components 239, 241, and two substantially U-shaped second components 237, 238, as illustrated in FIG. 9.

Figure 12:
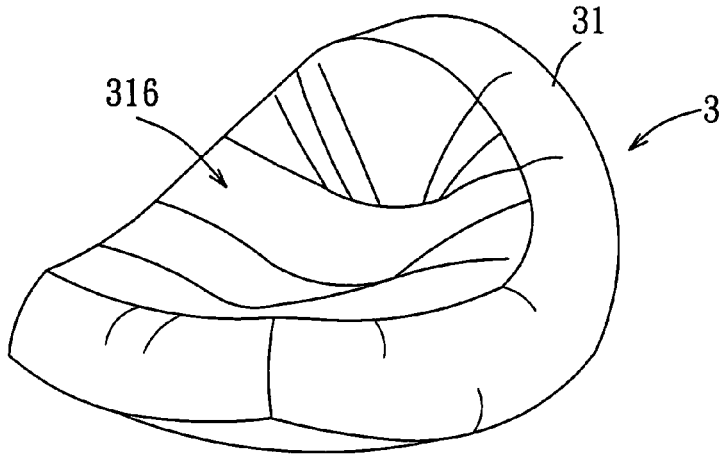
FIG. 12 is a perspective view of the combined seat and backrest unit of FIG. 11 in an assembled state.
Figure 13:
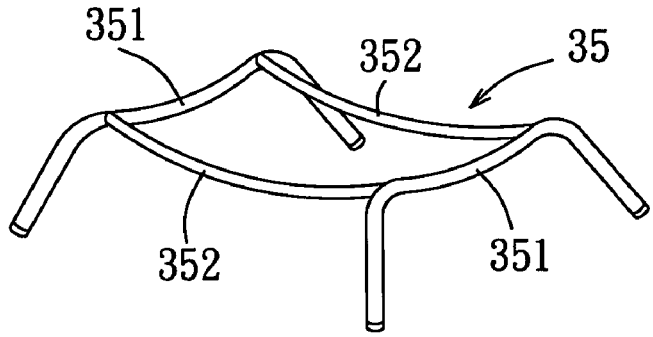
FIG. 13 is a perspective view of a leg frame of the third preferred embodiment.
Figure 14:
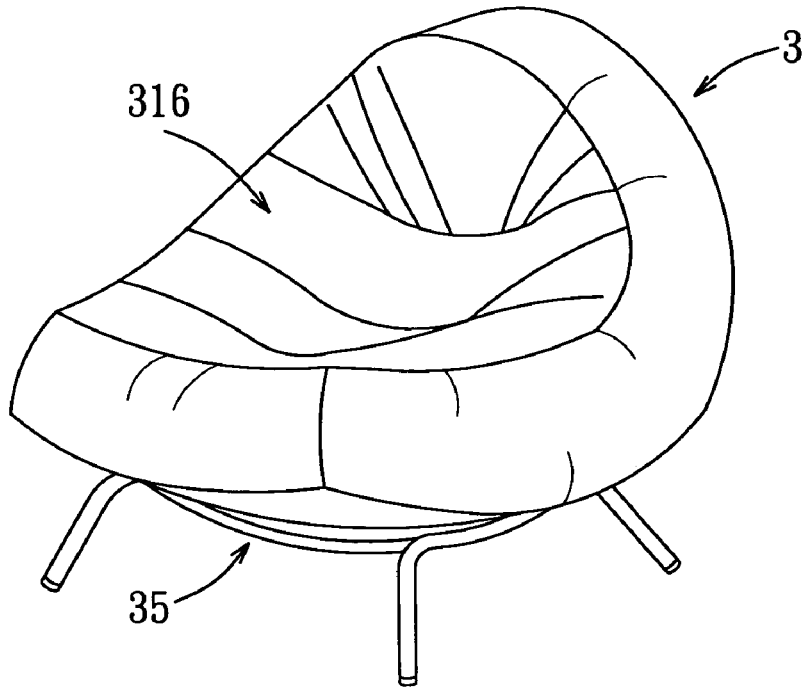
FIG. 14 is a perspective view of the third preferred embodiment of the furniture assembly of the present invention.

Referring to FIGS. 11 to 14, the third preferred embodiment of a furniture assembly 3 according to the present invention is shown to be similar to the first preferred embodiment. Particularly, the combined seat and backrest unit 316 of the furniture assembly 3 comprises an outer envelope 31, an inner envelope 32 disposed within the outer envelope 31, and an inner frame 34. However, in this embodiment, the combined seat and backrest unit 316 has a shape as shown in FIG. 12 after the inner envelope 32 and the inner frame 34 are inserted respectively into upper and lower receiving chambers 314, 315 of the outer envelope 31, and after the inner envelope 32 is filled with a cushioning material.

The furniture assembly 3 further comprises a leg frame 35 for supporting the combined seat and backrest unit 316 on the ground. In this embodiment, the leg frame 35 includes two substantially inverted-U shaped front and rear legs 351, and two spaced-apart cross bars 352 interconnecting the inverted-U shaped front and rear legs 351.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A furniture assembly comprising:

a flexible outer envelope including an upper receiving chamber, an upper access opening in communication with said upper receiving chamber, a lower receiving chamber, and a lower access opening in communication with said lower receiving chamber;

an inner envelope disposed in said upper receiving chamber and filled with a cushioning material; and a rigid inner frame disposed in said lower receiving chamber.

2. The furniture assembly as claimed in claim 1, wherein said outer envelope further includes a partition sheet for separating said upper and lower receiving chambers.

3. The furniture assembly as claimed in claim 1, wherein said outer envelope further includes a closure member to close said upper and lower access openings.

4. The furniture assembly as claimed in claim 1, wherein said outer envelope, said inner frame and said inner envelope cooperatively form a combined seat and backrest unit.

5. The furniture assembly as claimed in claim 4, wherein said inner frame is formed as a combined seat and backrest frame, and said inner envelope is shaped to match with said inner frame.

6. The furniture assembly as claimed in claim 5, wherein said inner frame includes at least one pair of left and right support rods, each of which has front and rear ends, a front bent rod extending across and connected to said front ends of said left and right support rods, and a rear bent rod extending across and connected to said rear ends of said left and right support rods.

7. The furniture assembly as claimed in claim 6, wherein each of said left and right support rods has a front rod section, a rear rod section which is pivotable relative to said front rod section, and an angle adjusting and limiting unit connected to said front and rear rod sections to adjust an angle between said front and rear rod sections.

8. The furniture assembly as claimed in claim 4, further comprising a leg frame for supporting said combined seat and backrest unit on the ground.

9. The furniture assembly as claimed in claim 8, wherein said leg frame includes two substantially inverted-C shaped legs, each of which has front and rear ends, a front cross bar interconnecting said front ends of said inverted-C shaped legs, and a rear cross bar interconnecting said rear ends of said inverted-C shaped legs.

10. The furniture assembly as claimed in claim 8, wherein said leg frame includes two substantially inverted-U shaped legs, each of which has front and rear ends, a front cross bar interconnecting said front ends of said inverted-U shaped legs, a rear cross bar interconnecting said rear ends of said inverted-U shaped legs, and an intermediate cross bar interconnecting said front and rear cross bars.

11. The furniture assembly as claimed in claim 8, wherein said leg frame includes two substantially inverted-U shaped front and rear legs, and two spaced-apart cross bars interconnecting said inverted-U shaped front and rear legs.

12. The furniture assembly as claimed in claim 1, wherein said cushioning material is selected from the group consisting of air, water, and a foam material.

* * * * *